US006880444B2

(12) United States Patent
Ang

(10) Patent No.: US 6,880,444 B2
(45) Date of Patent: Apr. 19, 2005

(54) BLAST DIFFUSER

(75) Inventor: Teoh Hwa Ang, Singapore (SG)

(73) Assignee: Ordance Development and Engineering Company of Singapore (SG)

( * ) Notice: Subject to any disclaimer, the term of this patent is extended or adjusted under 35 U.S.C. 154(b) by 0 days.

(21) Appl. No.: 10/433,516

(22) PCT Filed: Jul. 10, 2002

(86) PCT No.: PCT/SG02/00159

§ 371 (c)(1),
(2), (4) Date: Apr. 2, 2004

(87) PCT Pub. No.: WO03/008892

PCT Pub. Date: Jan. 30, 2003

(65) Prior Publication Data

US 2004/0154462 A1 Aug. 12, 2004

(30) Foreign Application Priority Data

Jul. 19, 2001 (SG) ..... 200104409-8

(51) Int. Cl.[7] ..... F41A 21/30
(52) U.S. Cl. ..... 89/14.4; 89/14.3
(58) Field of Search ..... 89/14.3, 14.4; 42/76.01

(56) References Cited

U.S. PATENT DOCUMENTS

| | | | | | |
|---|---|---|---|---|---|
| 1,000,702 | A | * | 8/1911 | Thurler | 181/223 |
| 1,390,658 | A | | 9/1921 | Towson | |
| 1,939,700 | A | | 12/1933 | Hofstetter | |
| 2,112,831 | A | * | 4/1938 | Cutts, Jr. | 89/14.3 |
| 2,765,706 | A | * | 10/1956 | Strohl | 89/14.3 |
| 2,916,970 | A | * | 12/1959 | Mutter | 89/14.3 |
| 4,291,610 | A | | 9/1981 | Waiser | |
| 4,307,652 | A | | 12/1981 | Witt et al. | |
| 4,562,767 | A | | 1/1986 | Janssen et al. | |
| 5,036,747 | A | | 8/1991 | McClain, III | |
| 5,164,535 | A | | 11/1992 | Leasure | |
| 5,367,940 | A | | 11/1994 | Taylor | |
| 5,814,757 | A | | 9/1998 | Buss | |

FOREIGN PATENT DOCUMENTS

| | | | | |
|---|---|---|---|---|
| CH | 223326 | * | 11/1942 | 89/14.3 |
| EP | 0 723 131 A1 | | 7/1996 | |
| FR | 492535 | * | 7/1919 | 89/14.4 |
| FR | 866587 | * | 8/1941 | 89/14.4 |
| IT | 244320 | * | 1/1926 | 89/14.3 |
| SG | 200104409-8 | | 6/2004 | |
| WO | PCT/SG02/00159 | | 1/2003 | |

* cited by examiner

*Primary Examiner*—Stephen M. Johnson
(74) *Attorney, Agent, or Firm*—Townsend and Townsend and Crew LLP

(57) ABSTRACT

A blast diffuser for a gun, comprising bore means having a surface defining a barrel through which a projectile may be discharged when the diffuser is attached, in use, to a gun barrel, the blast diffuser further comprising a primary chamber arranged around the outside of the bore means and a secondary chamber adjacent to an outer surface of the primary chamber, wherein a plurality of holes are arranged in the surface of the bore means to the primary chamber, and a plurality of holes are arranged in the outer surface of the primary chamber to allow passage of combustion gases from the primary many chamber to the secondary chamber, the secondary chamber further comprising an opening to allow the escape of combustion gases into the atmosphere.

17 Claims, 6 Drawing Sheets

Table 1

| Distance form Muzzle | | | 1.0 meter | | | 1.5 meter | | | 2.0 meter | | |
|---|---|---|---|---|---|---|---|---|---|---|---|
| | | | Pressure | | Duration | Pressure | | Duration | Pressure | | Duration |
| Measurement | | | (mbar) | (dB) | (ms) | (mbar) | (dB) | (ms) | (mbar) | (dB) | (ms) |
| Charge 9 | With | data 1 | 127.3 | 176.1 | 29.8 | 168.5 | 178.5 | 29.0 | 138.4 | 176.8 | 23.7 |
| | | data 2 | 161.4 | 178.1 | 24.3 | 159.7 | 178.0 | 25.0 | 161.2 | 178.1 | 21.8 |
| | | data 3 | 129.8 | 176.2 | 25.7 | 154.5 | 177.8 | 28.5 | 161.7 | 178.2 | 21.8 |
| | | Average | 139.5 | 176.8 | 26.6 | 160.9 | 178.1 | 27.5 | 153.8 | 177.7 | 22.4 |
| | Without | data 4 | 359.6 | 185.1 | 22.7 | 218.3 | 180.8 | 21.9 | 174.6 | 178.8 | 21.6 |
| | | data 5 | 365.7 | 185.2 | 22.5 | 244.2 | 181.7 | 21.4 | 217.1 | 180.7 | 17.2 |
| | | data 6 | 392.3 | 185.9 | 22.1 | 258.2 | 182.2 | 21.9 | 182.2 | 179.2 | 21.2 |
| | | Average | 372.5 | 185.4 | 22.4 | 240.2 | 181.6 | 21.7 | 191.3 | 179.6 | 20.0 |
| Improvement by | | | 167% | 8.6 | — | 49% | 3.5 | — | 24% | 1.9 | — |

Table 2

| Distance form Muzzle | | | 1.0 meter | | | 1.5 meter | | | 2.0 meter | | |
|---|---|---|---|---|---|---|---|---|---|---|---|
| | | | Pressure | | Duration | Pressure | | Duration | Pressure | | Duration |
| Measurement | | | (mbar) | (dB) | (ms) | (mbar) | (dB) | (ms) | (mbar) | (dB) | (ms) |
| Charge 8 | With | data 1 | 113.0 | 175.0 | 26.1 | 145.7 | 177.2 | 22.7 | 143.2 | 177.1 | 22.1 |
| | | data 2 | 121.0 | 175.6 | 29.2 | 167.6 | 178.5 | 21.7 | 141.2 | 177.0 | 24.5 |
| | | data 3 | 110.0 | 174.8 | 27.6 | 144.9 | 177.2 | 21.3 | 142.2 | 177.0 | 20.9 |
| | | Average | 114.7 | 175.2 | 27.6 | 152.7 | 177.6 | 21.9 | 142.2 | 177.0 | 22.5 |
| | Without | data 4 | 271.1 | 182.6 | 13.5 | 257.3 | 182.2 | 12.2 | 114.7 | 175.2 | 16.4 |
| | | data 5 | 344.1 | 184.7 | 13.6 | 259.1 | 182.2 | 12.2 | 213.9 | 180.6 | 7.5 |
| | | data 6 | 362.2 | 185.2 | 12.7 | 271.5 | 182.7 | 12.6 | 132.6 | 176.4 | 19.9 |
| | | Average | 325.8 | 184.2 | 13.3 | 262.6 | 182.4 | 12.3 | 153.7 | 177.4 | 14.6 |
| Improvement by | | | 184% | 9.0 | — | 72% | 4.7 | — | 8% | 0.4 | — |

FIG. 5

BLAST DIFFUSER

FIELD OF THE INVENTION

The invention relates to a blast diffuser for reducing the sound pressure level caused by the high-pressure combustion gases generated by the firing of a gun. Although the description relates to the use of the blast diffuser to reduce the blast pressure from a mortar gun of preferably 120 mm calibre, it should be appreciated that the invention may be applied to guns with other calibres with suitable modifications.

BACKGROUND AND PRIOR ART

During the firing of large calibre guns, the combustion gases and pressure waves generated by the blast of the gun can be considerable. As a result, especially for guns of 120 mm calibre or greater, the operator of the gun has to station himself at a safe distance from the blast area to avoid injuries that may be caused by such pressure levels. In the case of muzzle-loaded weapons, such as mortars, the problem is more acute as it is necessary for the operator to be in relatively close proximity to the barrel in order to operate the weapon effectively.

Due to a desire to increase the rate of fire of a mortar gun, the peak sound pressure level at the operator's position when firing the mortar artillery system would tend to exceed the safety limit of the "Z line zone" as defined in the military standardization specifications MIL-STD 1474C ("Noise limits for military material"). This problem has constrained the firepower of the mortar system as it limits the total number of rounds that can be safely fired per day by an operator.

Conventionally, this problem may be resolved by remotely triggering the mortar firing. However, the rate of fire will be significantly reduced. The problem is accentuated by the development of modern mortar systems that are designed for high rates of fire with semi-automatic bomb loading systems.

There are various devices that have been developed to attenuate the sound pressure levels generated by the firing of a gun. A majority of these devices seek to divert the propellant gases leaving the gun barrel so that they may be allowed to expand or cool inside a chamber, or by drawing the propellant gases out of the barrel in a controlled manner. An example is U.S. Pat. No. 5,610,360 for a "Large Caliber Gun Muffler". The patent describes a muffler for a large calibre gun having a gun tube that includes a transition section fitted around the gun tube and engaging the gun tube for preventing the escape of residual combustion gases caused by the firing of a projectile by the gun. The transition section further includes a pressure vessel, vent stack, valve and exhaust blower to draw propellant gases out of the gun tube.

The device described in the patent is elaborate and contains many parts. It also includes external attachments such as an exhaust blower which increases the complexity of the operation. Whilst it may be workable in a gun-testing environment, it is not practical for field combat operations because of its complexity and bulk, that would add to the operational overheads.

SUMMARY OF THE INVENTION

It is thus an objective of the present invention to provide an improved blast diffuser to reduce the sound pressure levels affecting the operators of guns, especially large calibre guns.

One aspect of the present invention provides a blast diffuser for a gun, comprising bore means having a surface defining a barrel through which a projectile may be discharged when the diffuser is attached, in use to a gun barrel, the blast diffuser further comprising a plurality of primary chambers arranged around the outside of the bore means and a plurality of secondary chambers which are each adjacent to an outer surface of a respective one of the primary chambers, wherein a plurality of holes is arranged in the surface of the bore means to allow the passage of combustion gases from the bore means to the primary chambers, and a plurality of holes is arranged in the outer surface of each primary chamber to allow the passage of combustion gases from each primary chamber to a respective one of the secondary chambers, each secondary chamber further comprising an opening to allow the escape of combustion gases into the atmosphere.

Another aspect of the invention provides a gun having a blast diffuser, the gun comprising a gun barrel, a plurality of primary chambers arranged around the outside of the gun barrel and a plurality of secondary chambers which are each adjacent to an outer surface of a respective one of the primary chambers, wherein a plurality of holes is arranged in the surface of the gun barrel to allow the passage of combustion gases from the gun barrel to the primary chambers, and a plurality of holes is arranged in the outer surface of each primary chamber to allow the passage of combustion gases from each primary chamber to a respective one of the secondary chambers, each secondary chamber further comprising an opening to allow the escape of combustion gases into the atmosphere.

It will be convenient to hereinafter describe an embodiment of the present invention with reference to the accompanying drawings which illustrate one form of diffuser incorporating the invention. It is to be understood that the particularity of the drawings and the related description is not to be understood as superseding the generality of the broad description of the invention as defined in the claims.

BRIEF DESCRIPTION OF THE DRAWINGS

FIG. 5 comprises tables 1 and 2 giving test results relating to the use of the blast diffuser to fire charge 8 and charge 9 bombs for a mortar gun.

DETAILED DESCRIPTION OF THE PREFERRED EMBODIMENT OF THE INVENTION

Figure 1:
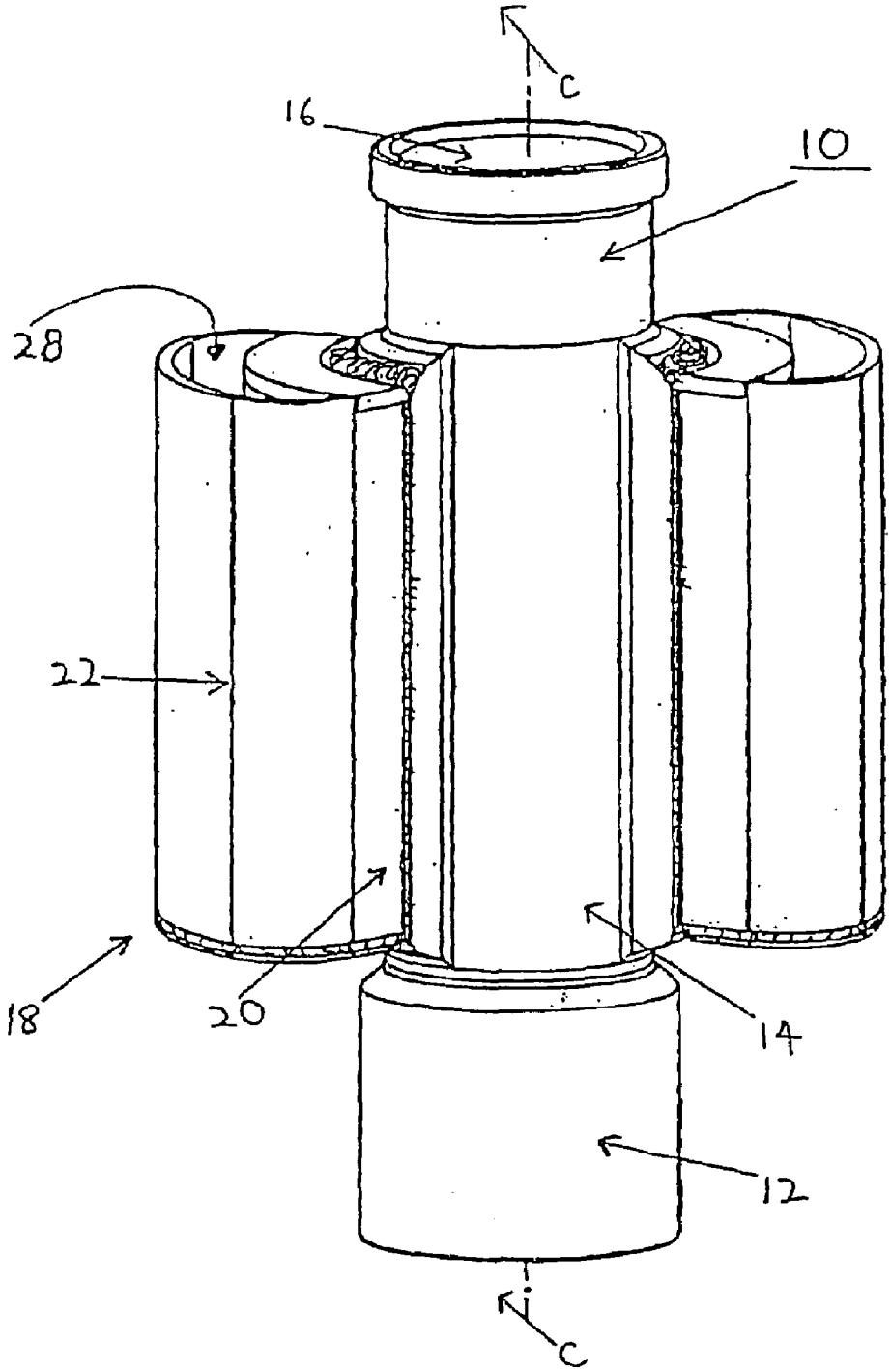
FIG. 1 is an isometric view of a blast diffuser according to a preferred embodiment of the invention.

FIG. 1 is an isometric view of a blast diffuser 10 according to a preferred embodiment of the invention. In the preferred embodiment, the blast diffuser 10 is adapted to be fitted onto the muzzle of a barrel of a mortar gun (indicated by numeral 11 in FIG. 2). The blast diffuser 10 comprises of a muzzle adapter 12, a diffuser barrel 14 and an opening 16 for the discharge of a projectile. Alternatively, the blast diffuser 10 may form a part of the barrel of the mortar gun itself, in which case the diffuser barrel 14 comprises a portion of the barrel of the mortar gun.

Adjacent to the diffuser barrel 14 are affixed attenuation attachments 18 on opposite sides of the diffuser barrel 14 consisting of primary chambers 20 connected to the diffuser barrel 14 and secondary chambers 22 connected to the primary chambers 20. It would be appreciated that during firing of a mortar bomb, the bomb projectile would travel past the muzzle adapter 12, diffuser barrel 14 and be discharged through the opening 16.

Figure 2:
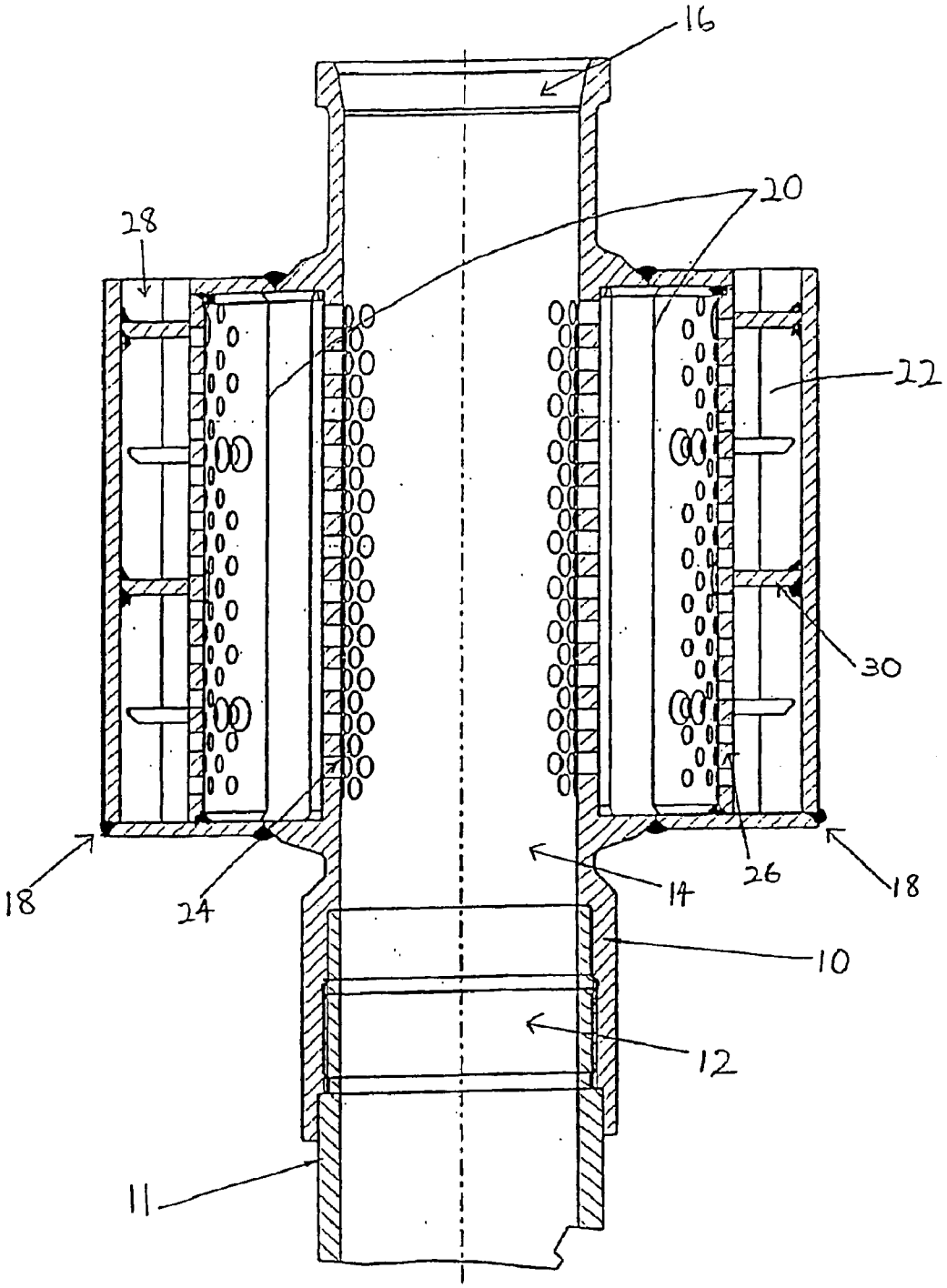
FIG. 2 is a cross-sectional view of the blast diffuser along line C—C of FIG. 1.

FIG. 2 is a cross-sectional view of the blast diffuser 10 along line C—C of FIG. 1. Along the surface of the diffuser barrel 14 between the diffuser barrel 14 and the primary chamber 20, there are a plurality of inner holes 24 that allow the escape of combustion gases from the diffuser barrel 14 to the primary chamber 20. The aim is to deflect the gases through an outlet in a direction substantially transverse to the trajectory of the projectile.

As illustrated in FIG. 2, the top and bottom of the primary chamber 20 are sealed, allowing the escape of combustion from the primary chamber 20 to the secondary chamber 22 only through the outer holes 26 found on the surface separating the primary chamber 20 and the secondary chamber 22. The secondary chamber 22 has a secondary chamber opening 28 at its top to allow escape of gases into the atmosphere. The bottom of the secondary chamber 22 is sealed.

During firing, a projectile (not shown) is propelled by high-pressure combustion gases. As the projectile passes through the blast diffuser 10, some of the gases will escape through the inner holes 24 of the diffuser barrel 14. These gases will expand into the primary chambers 20. Thereafter, these gases will escape through the outer holes 26 and further expand into the secondary chambers 22. The gases will then be discharged through the secondary chamber opening 28. Therefore, the gas pressure will be significantly reduced before the projectile leaves the barrel. Hence, the peak sound pressure level at the operator's position is also significantly reduced.

In addition, there are a series of deflection plates 30 interspersed in the secondary chambers 22 along the surface of the secondary chambers 22 next to the outer holes 26. The deflection plates 30 prevent smooth flow of the high-pressure gases to the secondary chamber openings 28 and thus further reduces the energy possessed by the gases before discharge into the atmosphere.

The blast diffuser will serve to reduce the peak sound pressure level at the operator's position to a safer level when firing large-calibre artillery systems. The improvement will assist substantially in the operation of modern artillery systems that are designed for high rates of fire and semi-automatic operation, in particular mortar systems.

Figure 3:
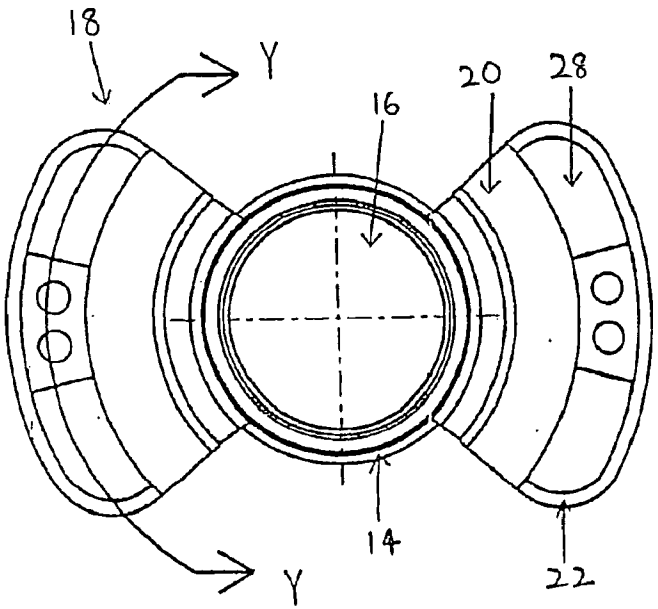
FIG. 3 is a plan view of the blast diffuser of FIG. 1.

FIG. 3 is a plan view of the blast diffuser 10 of FIG. 1. It shows the orientation of the primary chambers 20 and secondary chambers 22 relative to the diffuser barrel 14, as well as the secondary chamber opening 28 of the secondary chamber 22.

Figure 4:
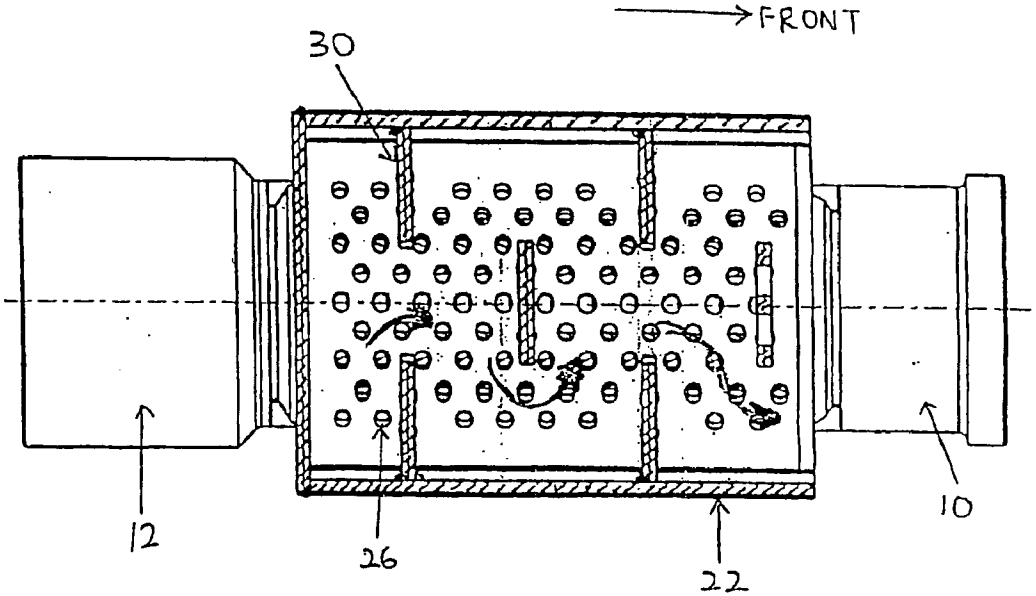
FIG. 4 is a sectional view of the blast diffuser along line Y—Y of FIG. 3 showing the outer holes and dispersion plates in more detail.

FIG. 4 is a sectional view of the blast diffuser along line Y—Y of FIG. 3 showing the outer holes and dispersion plates in more detail. The arrows illustrate the air-flow that is deflected by the deflection plates 30 to prevent smooth flow of the high-pressure gases to the secondary chambers openings 28 to further reduce the energy possessed by the gases before discharge into the atmosphere.

The test results of the blast diffuser that were conducted in accordance with MIL-STD-1474C are tabulated in Tables 1 & 2 of FIG. 5. The results show that the blast diffuser is able to reduce peak sound pressure level at one meter away from the barrel muzzle by 184% in pressure or 9.0 dB when firing charge 8 bombs and to reduce the peak sound pressure level by 167% in pressure or 8.6 dB when firing charge 9 bombs. Both these results bring the sound pressure levels to below the "Z line zone" as defined in the MIL-STD 1474C.

Figure 6:
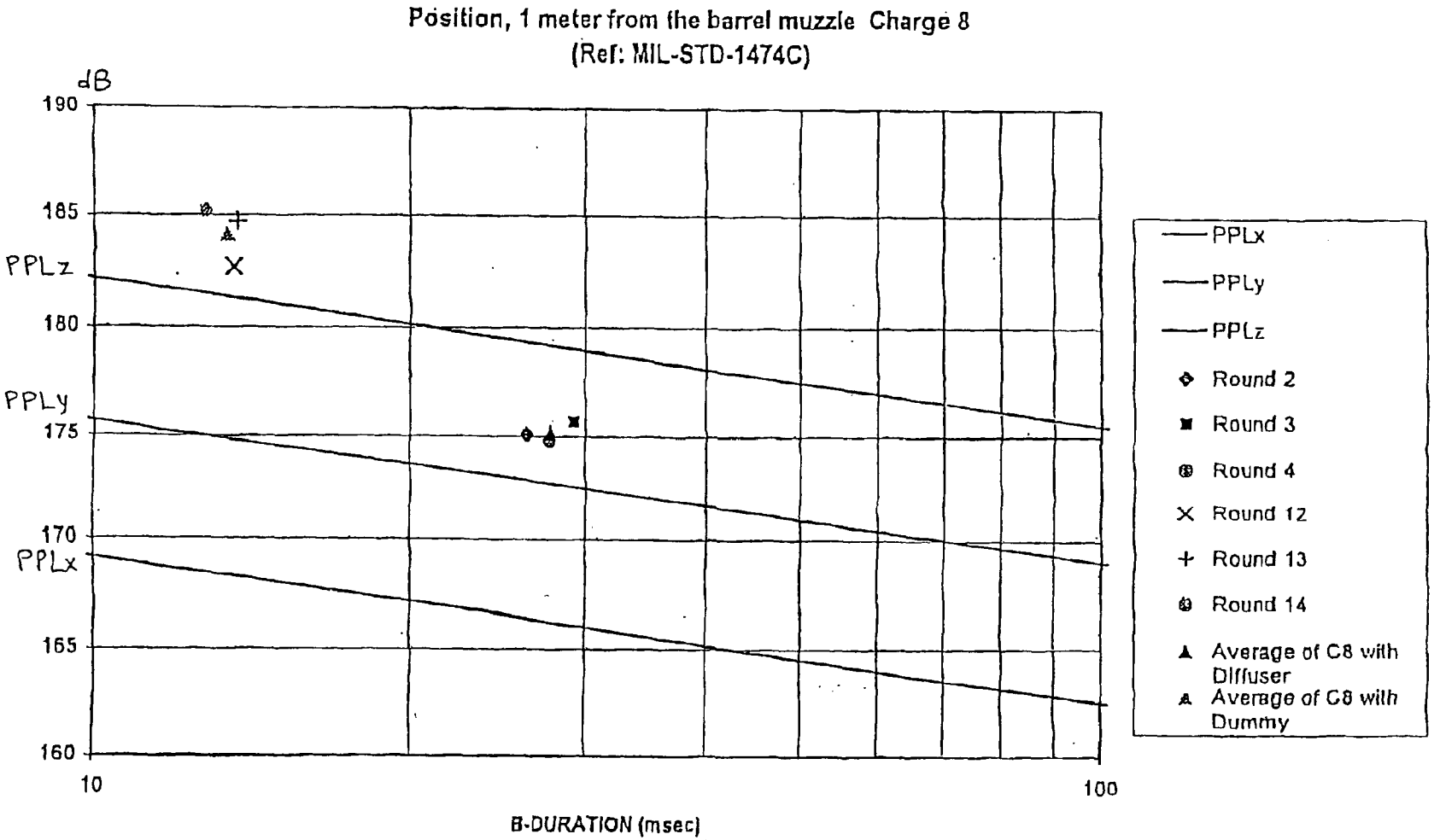
FIG. 6 is a graph showing the test-firing results at a position one meter from the barrel muzzle using a charge 8 round according to MIL-STD-1474C.
Figure 7:
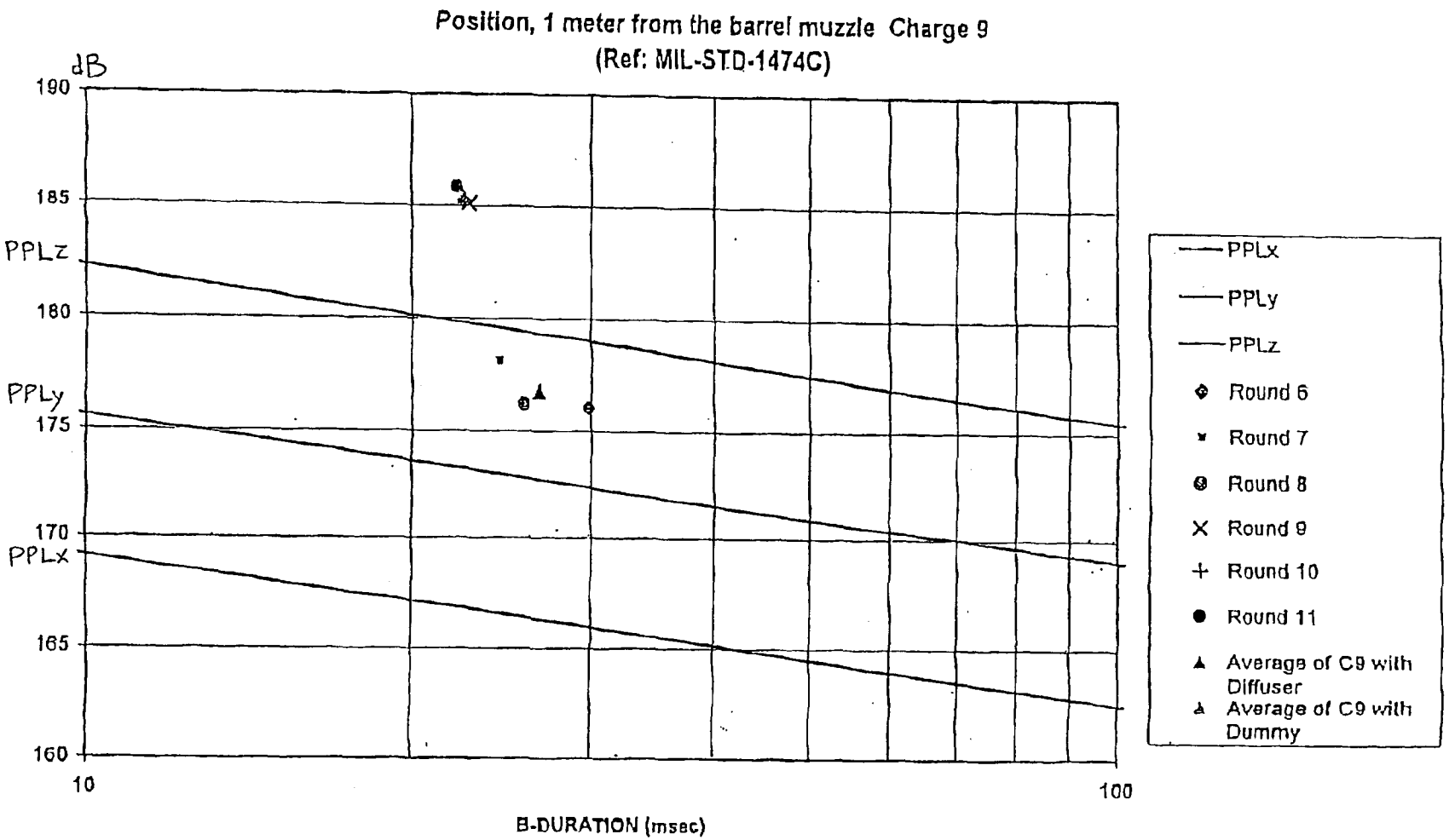
FIG. 7 is a graph showing the test-firing results at a position one meter from the barrel muzzle using a charge 9 round according to MIL-STD-1474C.

FIGS. 6 and 7 are graphs showing the test-firing results at a position one meter from the barrel muzzle using charge 8 and charge 9 rounds respectively according to MIL-STD-1474C. The "Z line zone" is represented by the area above PPLz. From the graphs, it is clear that barrel muzzles fitted with the blast diffuser according to the present invention are able to attain peak sound pressure levels at below the "Z line zone".

While a particular embodiment of the invention has been shown and described, it will be appreciated by those skilled in the art that changes and modifications of the present invention may be made without departing from the invention in broadest aspects. As such, the scope of the invention should not be limited by the particular embodiment and specific construction described herein but should be defined by the appended claims and equivalents thereof. Accordingly, the aim in the appended claims is to cover all such changes and modifications as fall within the spirit and scope of the invention.

What is claimed is:

1. A blast diffuser for a gun, comprising bore means having a surface defining a barrel through which a projectile may be discharged when the diffuser is attached, in use, to a gun barrel, the blast diffuser further comprising a plurality of primary chambers arranged around the outside of the bore means and a plurality of secondary chambers which are each adjacent to an outer surface of a respective one of the primary chambers, wherein a plurality of holes is arranged in the surface of the bore means to allow the passage of combustion gases from the bore means to the primary chambers, and a plurality of holes is arranged in the outer surface of each primary chamber to allow the passage of combustion gases from each primary chamber to a respective one of the secondary chambers, each secondary chamber further comprising an opening to allow the escape of combustion gases into the atmosphere.

2. A blast diffuser according to claim 1, wherein the secondary chambers are arranged radially outside the respective primary chambers, with respect to the bore means.

3. A blast diffuser according to claim 1, wherein the bore means and the primary chambers are arranged so that the passage of gases into the primary chambers is in a direction substantially transverse to the axis of the bore means.

4. A blast diffuser according to claim 1, wherein deflection means are provided in at least the secondary chambers for preventing smooth flow of the combustion gases.

5. A blast diffuser according claim 4, wherein the deflection means comprise one or more deflection plates.

6. A blast diffuser according to claim 5, wherein the one or more deflection plates are provided along the surface of the secondary chambers adjacent to the holes between the respective primary and secondary chambers.

7. A blast diffuser according to claim 1, comprising two attenuation portions arranged on diametrically opposite sides of the bore means, each attenuation portion comprising one of the primary chambers and a respective one of the secondary chambers.

8. A blast diffuser according to claim 1, wherein the openings in the secondary chambers are arranged so that combustion gases escape to the atmosphere in substantially the direction in which the gun is arranged to discharge a projectile.

9. A blast diffuser according to claim 1, further comprising a muzzle adapter at one end of the bore means for enabling attachment of the diffuser to the muzzle of a gun.

10. A gun having a blast diffuser, the gun comprising a gun barrel, a plurality of primary chambers arranged around the outside of the gun barrel and a plurality of secondary chambers which are each adjacent to an outer surface of a respective one of the primary chambers, wherein a plurality of holes is arranged in the surface of the gun barrel to allow the passage of combustion gases from the gun barrel to the primary chambers, and a plurality of holes is arranged in the outer surface of each primary chamber to allow the passage of combustion gases from each primary chamber to a respective one of the secondary chambers, each secondary chamber further comprising an opening to allow the escape of combustion gases into the atmosphere.

11. A gun according to claim 10, wherein the secondary chambers are arranged radially outside the respective primary chambers, with respect to the gun barrel.

12. A gun according to claim 10, wherein the gun barrel and primary chamber are arranged so that the passage of gases into the primary chambers is in a direction substantially transverse to the axis of the gun barrel.

13. A gun according to claim 10, wherein deflection means are provided in at least the secondary chambers for preventing smooth flow of the combustion gases.

14. A gun according claim 13, wherein the deflection means comprise one or more deflection plates.

15. A gun according to claim 14, wherein the one or more deflection plates are provided along the surface of the secondary chambers adjacent to the holes between the respective primary and secondary chambers.

16. A gun according to claim 10, comprising two attenuation portions arranged on diametrically opposite sides of the gun barrel, each attenuation portion comprising one of the primary chambers and a respective one of the secondary chambers.

17. A gun according to claim 10, wherein the openings in the secondary chambers are arranged so that combustion gases escape to the atmosphere in substantially the direction in which the gun is arranged to discharge a projectile.

* * * * *

UNITED STATES PATENT AND TRADEMARK OFFICE

CERTIFICATE OF CORRECTION

PATENT NO. : 6,880,444 B2
DATED : April 19, 2005
INVENTOR(S) : Teoh Hwa Ang

It is certified that error appears in the above-identified patent and that said Letters Patent is hereby corrected as shown below:

Title page,
Item [73], Assignee, should read -- Ordnance Development and Engineering Company of Singapore (1996) Pte Ltd. --

Signed and Sealed this

Fifth Day of July, 2005

JON W. DUDAS
*Director of the United States Patent and Trademark Office*